US005140116A

United States Patent [19]

Schmitt-Walter

[11] Patent Number: 5,140,116

[45] Date of Patent: Aug. 18, 1992

[54] ILLUMINATED PUSH-BUTTON SWITCH

[76] Inventor: Stefan Schmitt-Walter, Jagerstrasse 7b, 8024 Deisenhofen, Fed. Rep. of Germany

[21] Appl. No.: 781,807

[22] Filed: Oct. 28, 1991

Related U.S. Application Data

[63] Continuation-in-part of Ser. No. 583,563, Sep. 17, 1990, abandoned.

[30] Foreign Application Priority Data

Sep. 19, 1989 [DE] Fed. Rep. of Germany ... 8911184[U]

[51] Int. Cl.[5] ..... H01H 9/00; H01H 1/06

[52] U.S. Cl. ..... 200/314; 200/275; 200/313; 200/310

[58] Field of Search ..... 200/314, 310, 313, 275, 200/406

[56] References Cited

U.S. PATENT DOCUMENTS

| | | | |
|---|---|---|---|
| 2,747,166 | 5/1956 | Hoffarth | 200/275 |
| 4,088,855 | 5/1978 | Emery | 200/314 |
| 4,365,120 | 12/1982 | Pounds | 200/314 |
| 4,590,342 | 5/1986 | Schlegel | 200/314 |
| 4,910,368 | 3/1990 | Honda et al. | 200/314 |
| 5,036,441 | 7/1991 | Herron | 200/314 |

*Primary Examiner*—Henry J. Recla
*Assistant Examiner*—David J. Walczak
*Attorney, Agent, or Firm*—Finnegan, Henderson, Farabow, Garrett & Dunner

[57] ABSTRACT

An illuminated push-button switch comprising a support element for receiving therein a switching key, at least two contacts which are adapted to be connected to connecting leads, a deformable contact connection element as well as an interior light source, and a light exit window provided on the switch side equipped with the switching key. The switching key is displaced from an original position to an end position, whereby an electric connection between the contacts is established or/and eliminated by the deformation of the contact connection element, against a restoring force produced by the contact connection element when the contact connection element is being deformed. The support element and the contact connection element are each provided with an opening in such a way that the interior light source can be readily replaced from the side of the switch opposite the switching key.

16 Claims, 2 Drawing Sheets

ILLUMINATED PUSH-BUTTON SWITCH

BACKGROUND OF THE INVENTION

This application is a continuation-in-part of application Ser. No. 583,563, filed Sep. 17, 1990, now abandoned.

The present invention relates to an illuminated push-button switch. More particularly the switch includes a support element for receiving therein a switching key, at least two contacts which are adapted to be connected to connecting leads, an electrically deformable contact connection element as well as an interior light source. A light exit window is provided on the switch side equipped with the switching key, and the switching key is adapted to be displaced from an original position to an end position, whereby an electric connection between the contacts is established or/and eliminated by the deformation of the contact connection element, against a restoring force produced by the contact connection element when the contact connection element is being deformed.

In the case of known illuminated push-button switches of this type, the insertion of light sources (light bulbs, light-emitting diodes) and the removal of said light sources is carried out from the front side of the switch. For this purpose, the switches are equipped, e.g., with removable switching keys or with switching keys having a removable cap.

In the case of switchboards which have to fulfil specific requirements with regard to tightness, e.g., oil tightness, the accessibility of the switches from the front can be impeded by cover means, e.g., cover sheets, which cannot be removed or which can only be removed with very complicated measures.

The present invention provides an illuminated push-button switch of the type mentioned which, when used, e.g., in switchboards provided with a cover, permits a replacement of the light source which is less difficult than in the case of known illuminated push-button switches.

SUMMARY OF THE INVENTION

In accordance with the present invention, this is provided by the feature that the support element and the contact connection element are each provided with an opening in such a way that the interior light source can be introduced into the switch from the switch side located opposite the switching key.

On the basis of this solution according to the present invention, an illuminated push-button switch is available, which can, for example, advantageously be inserted in switchboards provided with a cover.

In the case of a preferred embodiment of the present invention, a contact connection element is provided, which has the structural design of a curved annular disc, said annular disc being especially curved approximately in the form of a plane wave.

Another expedient feature which can be provided is that the contact connection element has a stress-strain characteristic with a click when it is being deformed by the switching key.

BRIEF DESCRIPTION OF THE DRAWINGS

The present invention will now be explained and described on the basis of an embodiment and on the basis of the drawings enclosed, in which.

DESCRIPTION OF THE PREFERRED EMBODIMENTS

Figure 1:
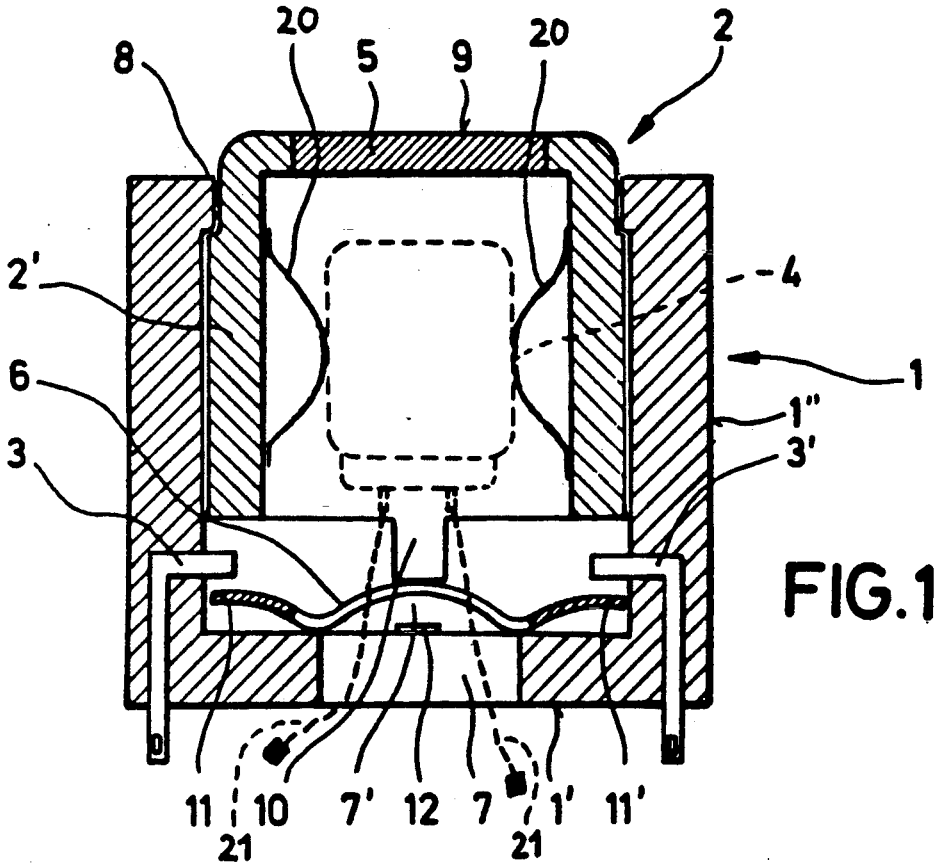
FIG. 1 is a sectional view of an embodiment of an illuminated push-button switch according to the present invention, which includes a curved annular disc as a contact connection element.
Figure 2:
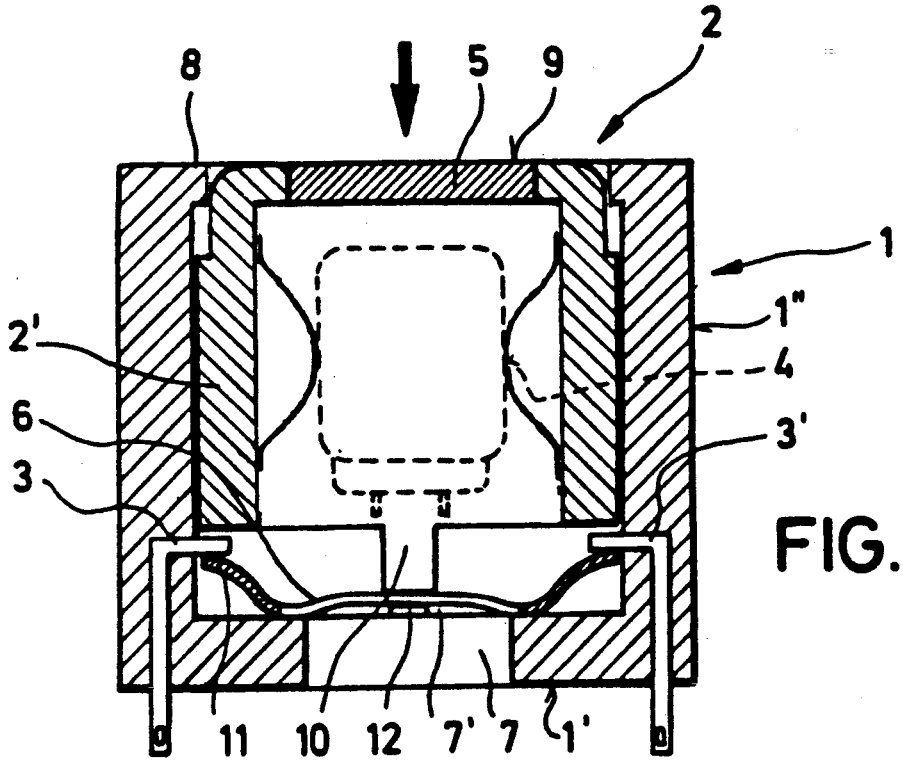
FIG. 2 shows the embodiment of FIG. 1 in a condition in which the switching key has been actuated.

In FIGS. 1 and 2, in which an essentially cylindrical switch is shown in a central longitudinal section, reference numeral 1 refers to a housing which is open on one side thereof and which consists of an insulated material. The housing has a base plate 1' and a cylindrical side wall 1". The base plate 1' is provided with a through hole 7, which is round in the case of the present embodiment. A projection 8 defining a constriction is provided on the inner side of the open end of the cylindrical wall 1" of the housing 1. The projection 8 defines a stop means for a push button or switching key 2, which is guided in said housing and which essentially is in the form of a hollow cylinder comprising a cylindrical wall 2', said hollow cylinder being open on one side thereof. A top wall 9, which closes said hollow cylinder on one side thereof to give the button an essentially dome-shaped configuration, defines a touch surface, and said wall 9 has provided therein a translucent window 5. At the end closed by the wall 9, the diameter of the push button is reduced an amount corresponding to the projection 8 projecting beyond the cylindrical wall 1" of the housing 1. At the other or open end, the cylindrical button has two peripheral noses 10 projecting along the cylindrical wall 2', one of which is shown in FIGS. 1 and 2. The noses abut a contact connection element 6, which is constructed as a curved or wavy annular disc in the case of the present embodiment and which consists of an elastic material, e.g., of sheet steel. The contact connection element 6 is provided with two contact noses 11 and 11', which are located opposite each other relative to a plane extending longitudinally through the axis of the cylindrical switch and at right angles to the plane of the section of FIGS. 1 and 2. Reference numerals 3 and 3' refer to contacts, which are associated with said contact noses 11 and 11'. The contacts, which are provided in the form of angular rods in the case of the present embodiment, are partly embedded in the wall 1" of the housing 1, which preferably consists of a plastic material, both ends of each contact projecting beyond the housing wall. The base plate 1' has provided thereon two stop noses 12, which are located opposite each other according to the section plane, FIGS. 1 and 2 showing one of said stop noses. It would also be possible to provide additional electric contacts instead of the stop noses, said electric contacts then serving as stop noses. The contacts 3, 3' and the contact noses 11, 11' associated therewith are made of a material suitable for making a reliable electric connection.

In FIGS. 1 and 2, reference numeral 7' refers to the central opening in the contact connection element 6 provided in the form of a wavy annular disc. Reference numeral 4 refers to an interior light source that is arranged within the switching key 2 and moves up and down with it, the interior light source being a light-emitting diode in the case of the present embodiment. Holding means, such as spring bows 20 are provided on the inside of the key or button 2 to hold light-emitting diode 4 in place and electrical leads 21 connected to diode 4 extend through the central opening 7' in contact connection element 6 and hole 7 in base plate 1' for connecting the diode to a source of electrical power.

Figure 3:
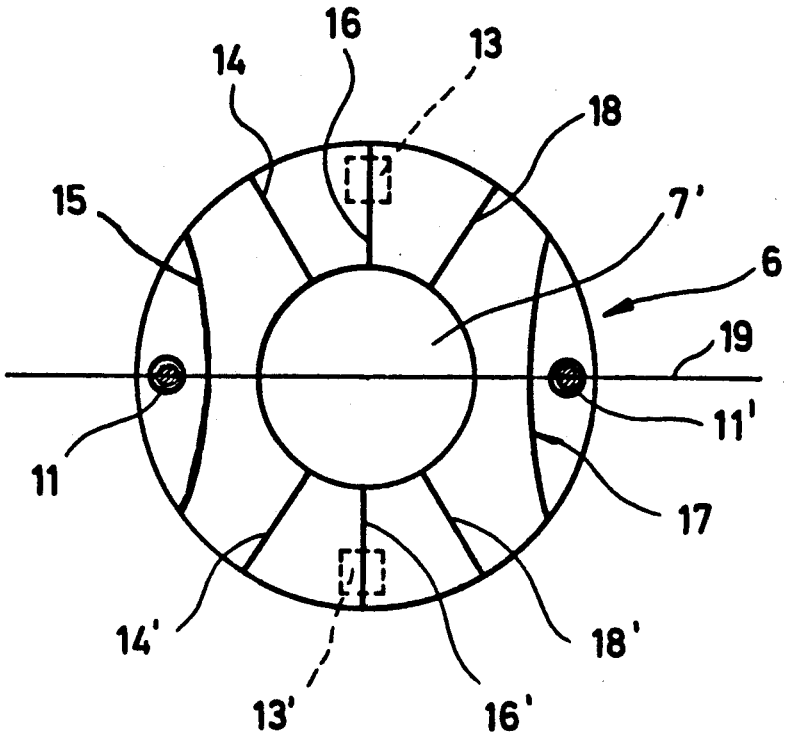
FIG. 3 is a top view of the contact connection element used in the embodiment of FIGS. 1 and 2, in the form of an annular disc having a wavelike curvature.

The contact connection element 6, in the form of a wavy annular disc, is shown separately in FIG. 3 from the side facing the push button 2 and includes central opening 7' and contact noses 11 and 11'. The element is curved approximately after the fashion of a plane harmonic wave along an axis referred to by reference numeral 19, the wave crest maxima occurring approximately at contour lines referred to by reference numerals 15, 16 and 16', 17, respectively, whereas the wave crest minima occur at contour lines 14 and 14' and 18 and 18', respectively. In the case of the present embodiment, each of the contour lines 14 and 15 as well as 17 and 18 is — deviating from a plane wave — slightly curved in a convex shape and symmetric with regard to the contour line 16. Deviating from the embodiment according to FIG. 3, the annular sheet metal defining the contact connection element may have provided therein comparatively sharp bends along the contour lines 14 to 18. The broken lines 13 and 13' indicate stop regions for the peripheral noses 10 of the push button.

In the case of the present embodiment of the illuminated push-button switch, the push button 2 is held in its original position as shown in FIG. 1, which exists as long as no pressure is applied to the push button 2, by means of the spring action of the contact connection element 6 abutting noses 10, the push button 2 being held in this position by the projection 8 on the cylindrical wall 1" of the housing 1. When the push button 2 is actuated, the noses 10 press the peripheral part of the contact element 6 between the contour lines 14 and 18 and 14' and 18', respectively, downwards until it abuts or rests on the stop noses 12, the lateral parts of the contact connection element outside of these contour lines coming up and thus into contact with the contacts 3 and 3' via the contact noses 11 and 11'. Thus an electric contact is established between said contacts 3 and 3' whose ends, which project beyond the switch housing, are adapted to be connected to electrical leads. The force with with which the contact noses 11, 11' are pressed up against the contacts 3, 3' can be influenced by the height of the stop noses 12, which can also be dispensed with, if desired. When the pressure acting on the push button is no longer applied, the switch will snap back into its original position under the influence of the now deformed contact connection element 6.

As can be seen in the drawings, light source 4 can be readily inserted and removed from the switch on the side located opposite the push button 2, by passing it through the openings 7 and 7'. It is thus possible to use the switch in an advantageous manner in sealed switchboards, which are provided with cover means and in the case of which the switches are accessible from the front side only to a limited extent.

In order to improve the ease of handling, the stress-strain characteristic of the contact connection element can have a specific length of displacement of the push button up to which the restoring force increases strongly, whereas, when said specific length of displacement is exceeded, the restoring force drops almost abruptly to a smaller value. The user of the switch then notices a distinct pressure point at which a click results.

Deviating from the embodiment shown, it would, of course, also be possible for the illuminated push-button switch according to the present invention to have more than two contacts which are to be connected. By actuating the switch, an electric connection between the contacts could not only be established but also eliminated.

Figure 4:
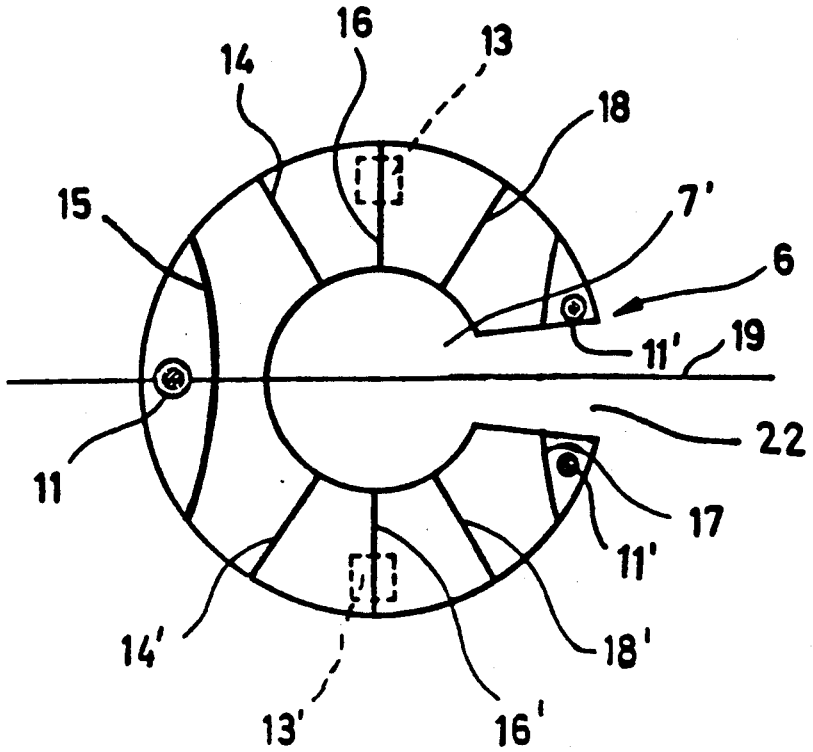
FIG. 4 is a top view of an alternative contact connection element of U-shaped configuration.

Moreover, elements which could be used as contact connection elements are not only closed annular rings, but also discs having a lateral opening 22, such as the one shown in FIG. 4 of U-shaped configuration. This would permit two contact noses 11; 11' to be provided on one side of element 6 that could be adapted to engage a pair of contacts 3' (not shown). Moreover, the shape of element 6 could differ significantly from the disc shape, so long as it has an adequate opening to permit removal of light source 4 according to the present invention.

We claim:

1. In an illuminated push-button switch having a housing, a push-button switching key mounted for movement within said housing, and having an actuation surface accessible from one side of the housing, at least two spaced electrical contacts located within said housing and adapted to be connected to electrical leads, an electrically conductive and deformable contact connection element located in said housing below said switching key and adjacent said contacts and an interior light generating means, said switching key upon actuation moving between an original position and an end position wherein it deforms said contact connection element to either bring it into contact with or out of contact with said contacts, the element generating a restoring force upon its deformation to return said key to its original position when the key is released, the improvement wherein said light generating means is located within said switching key so that it moves with said key and said element has an opening therein aligned with an opening in the housing on the side opposite from said one side of the housing to permit removal and replacement of the light generating means from inside the switching key through said openings.

2. The illuminated push-button switch of claim 1, wherein the contact connection element is a curved disc with the opening therein.

3. The illuminated push-button switch of claim 2, wherein the contact connection element has a lateral opening in the disc relative to the plane of the disc.

4. The illuminated push-button switch of claim 3, wherein the disc is substantially U-shaped.

5. The illuminated push-button switch of claim 2, wherein the disc is a curved annular disc with a central opening therein.

6. The illuminated push-button switch of claim 2, 3, 4, or 5, wherein the curved disc is in the form of a plane wave.

7. The illuminated push-button switch of claim 6, wherein the contact connection element has a stress-strain characteristic with a click when it is being deformed by the switching key.

8. The illuminated push-button switch of claim 1, wherein the housing includes a base plate having a through hole therein forming the opening of said housing.

9. The illuminated push-button switch of claim 8, wherein the disc is an annular disc with a central opening and the opening in the housing is concentric with the opening in the disc.

10. The illuminated push-button switch of claim 9, wherein the housing is open on said one side thereof with the actuation surface of said switching key protruding through said open side, said base plate of the housing being located opposite said open side of the housing.

11. The illuminated push-button switch of claim 10, wherein the housing is an essentially hollow cylinder.

12. The illuminated push-button switch of claim 11, wherein the switching key is guided within said cylinder.

13. The illuminated push-button switch of claim 12, wherein the switching key comprises an essentially hollow cylinder which is open at the side opposite said actuation surface thereof and adjacent to the base plate of the housing.

14. The illuminated push-button switch of claim 13, wherein the switching key is closed at the side opposite said open side to form a dome and is provided with a touch surface as the actuation surface of said switching key.

15. The illuminated push-button switch of claim 14, in which the switching key has peripheral pressure-exerting noses projecting from the open end of said key toward the contact connection element that deform the element when the key is pressed into the housing.

16. The illuminated push-button switch of claim 1 or 15, in which the actuation surface of the switching key is provided with a translucent window for emitting the light generated by the light generating means.

* * * * *